US005106817A

United States Patent [19]

Black et al.

[11] Patent Number: 5,106,817

[45] Date of Patent: Apr. 21, 1992

[54] THERMAL TRANSFER DYESHEETS

[75] Inventors: Simon N. Black, Chester; Roger J. Davey, Frodsham; Duncan H. MacKerron, Middlesbrough, all of Great Britain

[73] Assignee: Imperial Chemical Industries PLC, London, England

[21] Appl. No.: 446,556

[22] Filed: Dec. 5, 1989

[30] Foreign Application Priority Data

Dec. 5, 1988 [GB] United Kingdom ..... 8828343

[51] Int. Cl.[5] ..... B41M 5/035; B41M 5/26

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,725,284 2/1988 Black et al. ..... 8/471

FOREIGN PATENT DOCUMENTS 0209990 1/1987 European Pat. Off. ..... 503/227

*Primary Examiner*—Bruce H. Hess

*Attorney, Agent, or Firm*—Cushman, Darby & Cushman

[57] ABSTRACT

A cleaner thermal transfer dyesheet comprises a supportive base material coated with a composition of a thermally transferable dye dispersed throughout a polymer matrix, the dye being composed of organic molecules alignable to form crystals having a major axis, and a molecular structure having at least one carbon atom bonded to a single moiety and positioned in the molecule such that the size of said moiety effects the rate of crystal growth along the major axis; the coating having in addition to the dye molecules, a minor amount of a crystallization modifier consisting of molecules essentially the same as the dye molecules except that said moiety is replaced by a more bulky substituent.

Likewise, where the dye is recognized as having a molecular structure with one or more carbon atoms each bonded to a single moiety positioned to extend from the prime face, a crystallization modifier consists of molecules essentially the same as the dye molecules except that said moiety is replaced by a more bulky substituent.

The effect of adding a minor amount of such crystallization modifie is to provide a cleaner, more stable dyesheet.

4 Claims, No Drawings

THERMAL TRANSFER DYESHEETS

The invention relates to dyesheets for thermal transfer printing and in particular to the composition of dye-containing layers in such dyesheets.

Thermal transfer printing is a technology by which prints can be obtained from electronic signals, by heating selected areas of a dyesheet to cause dye to be transferred to a receiver sheet held adjacent to the dyesheet. The areas to be heated are selected in an appropriate transfer printing apparatus according to the electronic signals and provide individual pixels which together combine to form a print representing those electronic signals. This may be in the form of recorded data, comprising for example letters, numbers and diagrams in a single colour, but the technology is broader in its application potential than that, in that by using a plurality of appropriate dyes and small pixels, a colour print can be built up from appropriate signals, such as those derived from a video or electronic still camera.

Typically a thermal transfer dyesheet comprises a supportive base material coated with a composition of a thermally transferable dye dispersed throughout a binder matrix. The supportive base material is typically a thin polymeric film, such as biaxially orientated polyester film. Other materials which are used include artificial paper. The binder matrix in which the dye is dispersed may typically be a silicone or cellulosic polymer, although other polymeric binders have also be used. However, although dyesheets may be produced by co-casting binder and dye from a common solvent onto the supporting film to form a coating which is initially satisfactorily uniform, a drawback common to most (possibly all) of such systems presently used is that such uniformity is only temporary. Over a period of time the surface of the dyesheet tends to become rough and the potential resolution reduced, although the latter may only become a problem where prints of photographic or near photographic standards are required. A more general problem is that the dyesheets tend to become dirty, in that some of the dye becomes increasingly easy to rub off the dyesheet, or to be otherwise transferred, when the dyesheet is handled.

We have now found a way of modifying the coating composition so as to reduce these problems. This is based on the discovery that the problem arises through the dispersed dye molecules agglomerating to produce a separate phase in the form of small crystals. Like other crystals, these have fundamental axes of symmetry, and that along which the length of the crystal is greatest will be referred to herein as "the major axis", all others being considered as minor axes. Similarly, any face transverse (but not necessarily orthogonal) to the major axis, being a face on which during crystal growth molecular deposition effects extension of the major axis, will be identified herein as "a prime face", despite such faces having generally only a relatively small area.

We have further found that if small moieties bonded to certain carbon atoms of the dye, are replaced by more bulky substituents, crystal growth along one of the axes may be hindered, the axis affected being determined by the position of the carbon atom substituted. By controlling crystal growth along certain selected axes of the dye crystals, we are now able to provide improved dyesheets.

Accordingly, the present invention provides a thermal transfer dyesheet comprising a supportive base material coated with a composition of a thermally transferable dye dispersed throughout a polymer motrix, the dye being composed of organic molecules alignable to form crystals having a major axis as hereinbefore defined, and a molecular structure having at least one carbon atom bonded to a single moiety and positioned in the molecule such that the size of said moiety effects the rate of crystal growth along the major axis, characterized in that the composition contains in addition to the dye molecules, a minor amount of a crystallisation modifier consisting of molecules essentially the same as the dye molecules except that said moiety is replaced by a more bulky substituent.

We find that dyesheets according to the invention suffer less from the problems described above. We also find that when the same bulky substituents are introduced at other positions on the molecule, very little relief from the above problems is obtained. When the present dyesheets are examined microscopically after maturing for an appropriate period, although crystals can still be seen on the surface, they are shorter than those which grow when no much substituted molecules are added. However if crystal growth is hindered along other crystal axes by substituting bulky groups for smaller moeties on other carbon atoms, the resulting dyesheets are not relieved of the above problems, or are relieved only to a significantly lesser extent.

We prefer generally to replace only one such moiety per molecule, thereby to provide a molecule having substantially the same shape, charge distribution and hydrogen bonding pattern as the dye molecule, except for the single more-bulky substituent. This does, however, depend to some extent on the size of the dye molecule.

From these bulk observations, what appears to be happening (although this is provided by way of explanation and is not intended to be limiting) is that the relevant carbon atom is bonded to a single moiety positioned to extend from said prime face in the growing crystal. By having a similar shape, charge distribution and hydrogen bonding pattern to the unchanged portion, the modified molecule can add to the groving prime face, but once in place the bulkier substituent hinders further growth at that face, growth along other axes remaining relatively unchanged.

Accordingly, the present invention also provides a thermal transfer dyesheet comprising a supportive base material coated with a composition of a thermally transferable dye dispersed throughout a polymeric matrix, the dye being composed of organic molecules alignable to form crystals having at least one prime face as hereinbefore defined, and a molecular structure having one or more carbon atoms each bonded to a single moiety positioned to extend from said prime face, characterised in that the composition contains in addition to the dye molecules, a minor amount of a crystallisation modifier consisting of molecules essentially the same as the dye molecules except that at least one of its said moieties is replaced by a more bulky substituent.

The minor proportion of modified dye can be quite small, amounts of 0.01 to 10% by weight of the unmodified dye, depending on the modification, generally being sufficient. We have also used larger quantities, e.g. 20–30%, generally with corresponding increases in effect, but where the colours of modified and unmodified dyes do not match, increasing amounts also increasingly corrupt the colour obtained. It is therefore desirable to use as little as possible of the modified dye consistent with obtaining sufficient crystal growth modification.

Dyes which we have found to benefit particularly from such additives, are the anthraquinone dyes having rod-like molecules that lie transverse to the major axis of the crystal. Substitution of moieties at the ends of such molecules has very little effect on the cleanliness of dyesheets incorporating them, but lateral substituents have a much more pronounced effect.

The invention is illustrated by the following examples, based on 1-amino-2-phenoxy-4-hydroxy-anthraquinone, a red anthraquinone dye having the structure I below.

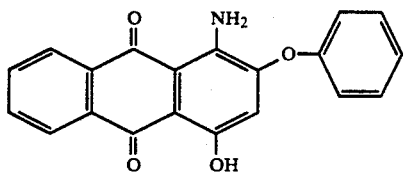

I

This is a dye which naturally crystalises as rods of high aspect ratio, amalgamating to form spiky rosettes, in a typical silicone binder. It is also known to form crystals with its molecules lying transverse to the major axis of the crystal, and essentially in or parallel to the prime faces. Thus, this dye provides a good example of the problems referred to above, and forms the basis of Example 1, which is provided for comparison purposes.

EXAMPLE 1

A dye binder film was cast onto a substrate of Melinex polyester film, from a solution of a thermally curable silicone resin and the above dye in methyl ethyl ketone, this being a common solvent for the two constituents. Immediately upon removal of the solvent, the film appeared as an amorphous, featureless blend of polymer and dye. However, before thermal curing of the silicone matrix was complete, the red dye was seen to crystallise. Large growths, which would probably be spherulitic in the bulk, appeared as two dimensional rosettes, several tens of microns in diameter, in the binder film, whose thickness was about one micron. The image of such rosettes could be transferred to a receiver sheet during thermal printing. In addition the film became increasingly dirty in that red dye tended to rub off onto one's hands when handling the dyesheet.

EXAMPLES 2 to 5

The rosettes of Example 1 were produced too vigorously to provide a convenient quantitative assessment of the affect of the present additives, and so their crystallisation characteristics were investigated by making saturated solutions of the dye compositions in methylene chloride, and cooling to grow crystals of the solute, the dye composition in each case being as identified below. The crystals grew as rods of varying aspect ratios, these being the measured lengths of the crystal divided by its breadth. Several crystals were measured in each example, and representative values obtained are quoted below.

EXAMPLE 2

This is a further comparative example, carried out to provide a control for those following. In this example the dye composition contained dye alone.

The aspect ratio of the dye crystals was 30.

EXAMPLE 3

This example is provided to show the effect of replacing a lateral substituent on the anthraquinone nucleus, with a more bulky molecule. The modified compound was 1-amino-2-phenoxy-4-(4-methyl aniline)-anthraquinone, having the structure II below, and was present in the dye composition in amount of 10% by weight of the dye.

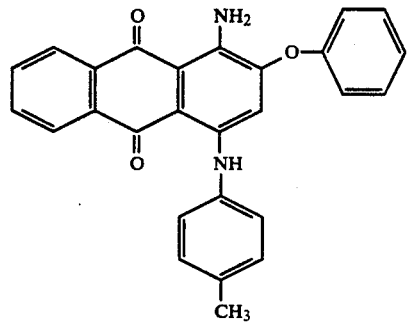

II

The aspect ratio of the crystals was 3.

EXAMPLE 4

In this example the dye composition consisted of the dye and 10% by weight of the dye of 1-amino-2-(2-hydroxy phenoxy)-4-hydroxy-anthraquinone, having the structure III below.

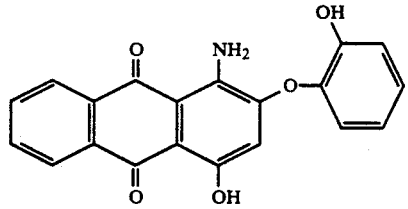

III

The aspect ratio of the crystals was 2.

EXAMPLE 5

This Example provides a further example of lateral substition in the phenoxy substituent, the quantity used again being 10% by weight of the dye, the modified dye being 1-amino-2-(2-fluoro phenoxy)-4-hydroxy-anthraquinone, having the structure IV below.

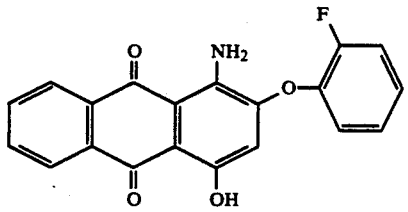

IV

The aspect ratio of the crystals was 7.

EXAMPLE 6

This is a further comparative example in which the phenoxy substituent is again modified, but this time substituting a terminal position rather than a lateral position of the previous examples. The modified dye was 1-amino-2-(4-t butyl phenoxy)-4-hydroxyanthraquinone, having the structure V below.

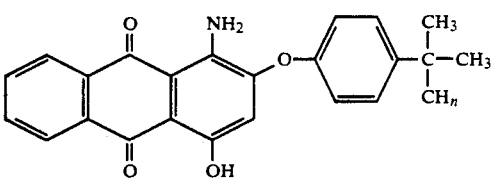

Y

This was used in concentrations varying between 4.6 and 13.5% by weight of the dye. These compositions were deposited with an ethyl hydroxy ethyl cellulose ("EHEC") binder from a common solvent, to form a thin film as in Example 1. These were compared with further films similarly cast, in which the dye composition was dye alone. In each case the amount of dye composition in the deposited film was about 13% by weight.

We found that on adding 4.6% of the compound V, there was little noticeable effect on the rate of crystallisation. Even at the higher amounts of 13.5%, the measured rate of crystalisation had only fallen to 0.5 mm/min compared with 0.7 mm/min when using dye alone.

EXAMPLES 7 TO 10

A further set of experiments was carried out using the above crystallisation modifiers, but like Example 6, the dye, or dye plus modifier where appropriate, were dispersed throughout a polymer matrix. The polymer used was polyvinyl acetate, and this, together with 20% by weight of dye and 3.8% of modifier where appropriate, was dissolved in methylene chloride.

A small amount of the resulting solution was coated onto a microscope slide, and allowed to dry to form a thin coat of the dye composition dispersed throughout the polymer. The stability of this coating was then examined while the temperature was steadily being increased. Using a microscope with a heated stage, the temperature was raised at the rate of 2° C. per minute, up to a maximum of 140° C. In each case, the temperature was recorded at which crystals first started to appear (the average crystallisation temperature), and that at which they covered the slide. The results are given in the table below, the lateral substitution of the anthraquinone being particularly effective at inhibiting crystallisation along the major axis.

| Ex | modifier | shape and size of crystals at 100° C. μm | shape and size of crystals at 100° C. μm | average crystallisation temp °C. | temp. to cover slide °C. |
|---|---|---|---|---|---|
| 7 | none | rosettes 20 | rosettes 80 | 95.2 | 112.6 |
| 8 | II | finer rosettes 20 | finer rosettes 70 | 106.0 | >140* |
| 9 | III | rosettes 10 | rosettes 70 | 100.4 | 116.4 |
| 10 | IV | rosettes 20 | rosettes 90 | 96.9 | 120 |

*finer rosettes did not cover the whole slide

We claim:

1. A thermal transfer dyesheet comprising a supportive base material coated with a composition of a thermally transferable dye dispersed throughout a polymeric matrix, the dye being a substituted 2-phenoxy anthraquinone, wherein the composition contains in addition to the dye molecules, a minor amount of a crystallization modifier consisting of molecules of the dye in which the phenoxy 2-position has been substituted by a more bulky substituent.

2. A thermal transfer dyesheet as claimed in claim 1, characterised in that only one such moiety per molecule is replaced, thereby providing a modifier having molecules substantially the same as the dye molecule, except for the single more-bulky substituent.

3. A thermal transfer dyesheet comprising a supportive base material coated with a composition of a thermally transferable dye dispersed throughout a polymeric matrix, the dye being, a substituted 2-phenoxy anthraquinone, wherein the composition contains in addition to the dye molecules, a minor amount of a crystallization modifier consisting of molecules of the dye in which the phenoxy 2-position has been substituted by a more bulky substituent.

4. A thermal transfer dyesheet as claimed in any one of claims 1 to 3, characterised in that the dye is a substituted 2-phenoxy anthraquinone, and the crystallisation modifier consists of molecules of the dye in which the 4-position of the anthraquinone nucleus is substituted by the more bulky substituent.

* * * * *